US011685175B2

(12) United States Patent
Ishida

(10) Patent No.: US 11,685,175 B2
(45) Date of Patent: Jun. 27, 2023

(54) PRINTING APPARATUS

(71) Applicant: SEIKO EPSON CORPORATION, Tokyo (JP)

(72) Inventor: Tetsugo Ishida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 259 days.

(21) Appl. No.: 17/144,249

(22) Filed: Jan. 8, 2021

(65) Prior Publication Data

US 2021/0213760 A1 Jul. 15, 2021

(30) Foreign Application Priority Data

Jan. 10, 2020 (JP) ..... 2020-002658

(51) Int. Cl.
*B41J 11/66* (2006.01)
*B41J 11/70* (2006.01)

(52) U.S. Cl.
CPC ..... *B41J 11/666* (2013.01); *B41J 11/706* (2013.01)

(58) Field of Classification Search
CPC ..... B41J 11/666
See application file for complete search history.

(56) References Cited

U.S. PATENT DOCUMENTS 5,235,887 A * 8/1993 Moriya ..... B26D 7/015 83/695
5,749,277 A * 5/1998 Walker ..... B26D 5/08 83/563
6,109,154 A * 8/2000 Miyatsu ..... B41J 11/70 83/695
6,152,007 A * 11/2000 Sato ..... B26D 1/085 83/636
7,273,325 B2 * 9/2007 Watanabe ..... B41J 15/042 400/621
8,267,603 B2 * 9/2012 Morita ..... B41J 11/70 400/621

FOREIGN PATENT DOCUMENTS

CN 1657239 A * 8/2005 ..... B26D 1/0006
CN 107206610 B * 11/2019 ..... B26D 1/08
EP 0707927 A1 * 4/1995 ..... B26D 1/08
EP 1506875 A2 * 2/2005 ..... B26D 1/0006
JP 2006-181673 A 7/2006
JP 2006181673 A * 7/2006
WO WO-9426478 A1 * 11/1994 ..... B26D 1/0006
WO WO-2006114823 A1 * 11/2006 ..... B26D 1/085

* cited by examiner

*Primary Examiner* — Sean M Michalski
*Assistant Examiner* — Fernando A Ayala
(74) *Attorney, Agent, or Firm* — Global IP Counselors, LLP

(57) ABSTRACT

A printing apparatus is able to perform partial cutting in which a portion of thermal paper remains uncut and full cutting in which the thermal paper is completely cut, and the printing apparatus includes a movable blade, a plate, and a driven gear. The plate includes a guide groove, the movable blade includes a guide shaft, the guide groove includes a first side and a second side, and the second side includes a certain portion extending in a direction away from the first side. When the driving gear rotates in a first rotational direction, the guide shaft changes a position with respect to the guide groove along the first side to perform the partial cutting, and when the driving gear rotates in a second rotational direction, the guide shaft changes the position with respect to the guide groove along the second side to perform the full cutting.

7 Claims, 13 Drawing Sheets

PRINTING APPARATUS

The present application is based on, and claims priority from JP Application Serial Number 2020-002658, filed Jan. 10, 2020, the disclosure of which is hereby incorporated by reference herein in its entirety.

BACKGROUND

1. Technical Field

The present disclosure relates to a printing apparatus.

2. Related Art

Printers that include a movable blade for cutting recording paper after printing and that change the stroke of the movable blade to perform partial cutting in which a portion of the recording paper remains uncut and full cutting in which the recording paper is completely cut are known (for example, refer to JP-A-2006-181673).

In printers of the related art, the movable blade is provided with a sliding member to change the stroke of the movable blade. Therefore, the sliding member may result in increased cost, and abrasion of the sliding member may increase the risk of failure.

SUMMARY

A printing apparatus according to an aspect is a printing apparatus configured to perform partial cutting in which a portion of recording paper remains uncut and full cutting in which the recording paper is completely cut, and the printing apparatus includes: a first blade; a plate configured to support the first blade; and a first rotating body that drives the first blade, in which one of the first blade and the plate includes a guide groove, the other of the first blade and the plate includes a guide shaft configured to be coupled to the guide groove, the guide groove has a first side and a second side, the second side includes a certain portion that extends in a direction away from the first side, when the first rotating body rotates in a first rotational direction to move the first blade toward the recording paper, the guide shaft changes a position with respect to the guide groove along the first side and the first blade performs the partial cutting, and when the first rotating body rotates in a second rotational direction different from the first rotational direction to move the first blade toward the recording paper, the guide shaft changes the position with respect to the guide groove along the second side and the first blade performs the full cutting.

DESCRIPTION OF EXEMPLARY EMBODIMENTS

1. First Embodiment

1-1. Configuration of Printing Apparatus

Figure 1:
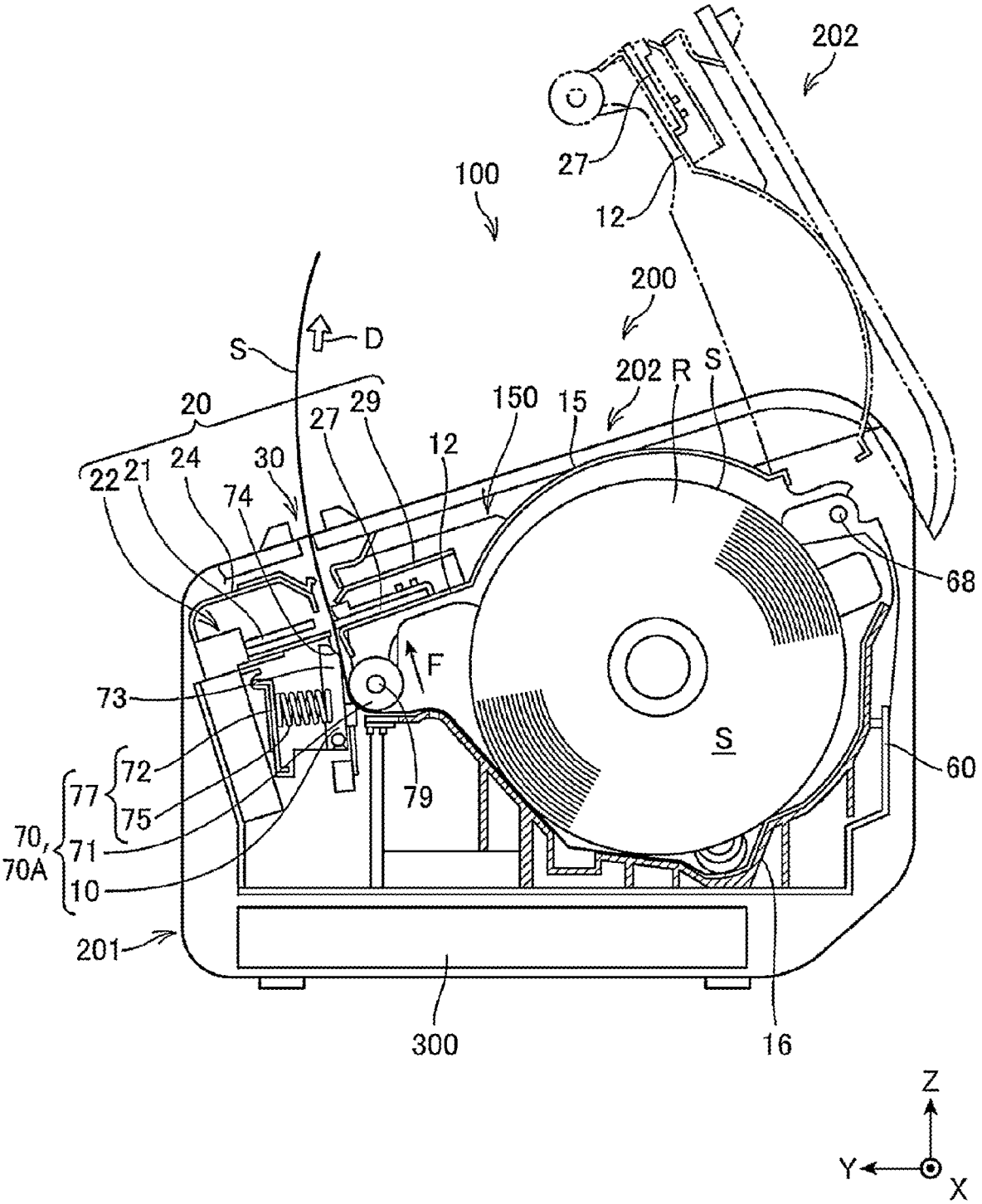
FIG. 1 is a sectional side view illustrating an overall configuration of a printing apparatus.

FIG. 1 is a sectional side view illustrating an overall configuration of a printing apparatus 100.

The printing apparatus 100 is applicable to, for example, a POS system. The POS system is a system usable in business such as the retail business of shopping malls, convenience stores, in-vehicle sales, and the like and the food service business of restaurants, cafes, pubs, and the like. The printing apparatus 100 prints and issues strip-like slips, receipts, coupons, tickets, or the like as individual sheets. The printing apparatus 100 is able to use long paper or sheets as recording paper for printing. The present embodiment describes an example in which the printing apparatus 100 is a thermal printer that performs printing on rolled thermal paper S as the recording paper. Note that the printing apparatus 100 is not limited to a thermal printer and may be a printing apparatus such as an ink jet printer that adopts a different printing system. Moreover, the recording paper may be referred to as a recording medium, a printing medium, or the like.

The printing apparatus 100 stores a paper roll R of the thermal paper S wound into a roll, draws out the thermal paper S from the paper roll R to transport the thermal paper S, prints certain information on the thermal paper S, and cuts the thermal paper S to a certain length. Note that the paper roll R may be a label paper roll, a unlined label paper roll, or the like.

In FIG. 1, the paper width direction of the thermal paper S is denoted by reference symbol X, the direction orthogonal to the X direction is denoted by reference symbol Y, and the direction orthogonal to the X direction and the Y direction is denoted by reference symbol Z. Moreover, the transport direction of the thermal paper S is denoted by reference symbol F.

As illustrated in FIG. 1, the printing apparatus 100 includes a printer mechanism 150, an outer case 200, and a control section 300. Note that the control section 300 may be referred to as a processor.

The outer case 200 includes a main body case 201 that covers a main body frame 60 and a cover case 202 that covers a cover frame 12.

The printer mechanism 150 includes the main body frame 60, the cover frame 12, a paper roll holder 16, a cutter mechanism 20, a paper discharge port 30, and a printing section 70. Note that the printing section 70 may function as a transport section 70A that transports the thermal paper S.

The main body frame 60 is substantially box shaped and has an opening upward in the Z direction. The cover frame 12 is attached to the main body frame 60 so as to be openable and closable about a support shaft 68. That is, the cover case 202 that covers the cover frame 12 is attached to the main body case 201, which covers the main body frame 60, so as to be openable and closable about the support shaft 68. The cover frame 12 may include a recess 15. The cover frame 12 includes the recess 15 to avoid contact with the paper roll R when the cover frame 12 is closed.

The paper roll holder 16 is a space covered by the cover frame 12 and is able to store the paper roll R. The paper discharge port 30 is an opening through which the thermal paper S is discharged. The paper discharge port 30 is an opening that is formed in the main body case 201 when the cover case 202 is closed. In the main body case 201 and the cover case 202 that form the paper discharge port 30, a portion of the paper discharge port 30 is provided in an end of the main body case 201 and a portion of the paper discharge port 30 is provided in an end of the cover case 202. Note that the paper discharge port 30 may be an opening formed in either the main body case 201 or the cover case 202. Further, the paper discharge port 30 may include, as a paper discharging function, a manual cutter for manually cutting the thermal paper S.

The printing section 70 is provided on a transport path D of the thermal paper S, which extends from the paper roll holder 16 to the paper discharge port 30. The printing section 70 includes a thermal head 10, a head holding mechanism 77, and a platen 71. The printing section 70 is able to be separated such that, when the cover frame 12 is opened, the thermal head 10 and the head holding mechanism 77 is on the main body frame 60 side and the platen 71 is on the cover frame 12 side. Note that the printing section 70 may be a constituent portion that forms the transport path D.

The thermal head 10 includes a plurality of heating elements (not illustrated) provided in the paper width direction, denoted by reference symbol X, and a heat dissipation plate 73. An inclined guide section 74 is provided at an upper part of the heat dissipation plate 73 in the Z direction. When the cover frame 12 is closed, the inclined guide section 74 guides the platen 71 described later to a certain position. In other words, the platen 71 slides on the inclined guide section 74 and reaches the certain position. Note that the inclined guide section 74 may be integrated with or separate from the heat dissipation plate 73.

The head holding mechanism 77 includes a head press plate 72 and an urging member 75 attached to the head press plate 72 and is attached to the main body frame 60. The urging member 75 is coupled to the head press plate 72 and the heat dissipation plate 73 of the thermal head 10 and urges the thermal head 10 toward the platen 71. Note that a spring member such as a compression coil spring is an example of the urging member 75.

The platen 71 is a roller formed from an elastic member such as rubber. The platen 71 is rotatably supported by the cover frame 12 via a platen bearing 79. When the cover frame 12 is closed, the platen 71 slides on the inclined guide section 74 of the thermal head 10 and abuts the heating elements of the thermal head 10 in an opposed manner. In other words, the platen 71 and the thermal head 10 are brought into pressure contact with each other.

The platen 71 abuts the thermal head 10 with the thermal paper S pinched therebetween. That is, the thermal head 10 and the platen 71 are pressed against the thermal paper S. When the platen 71 rotates in response to power of a paper feed motor (not illustrated), the thermal paper S is transported to the paper discharge port 30. The printing apparatus 100 selectively energizes the heating elements of the thermal head 10 while transporting the thermal paper S and prints certain information on the thermal paper S by using the heating elements that generate heat upon energization.

The thermal paper S on which printing has been preformed by the printing section 70 is cut by the cutter mechanism 20 to a certain length and issued as an individual sheet such as a receipt. Note that the printed thermal paper S may be cut leaving a certain margin near a printed image.

The control section 300 is provided in a lower portion of the printer mechanism 150 in the Z direction. The printer mechanism 150 is stored in the outer case 200 together with the control section 300. The control section 300 controls operation of the printing apparatus 100.

The control section 300 receives commands from a host computer (not illustrated) connected to the printing apparatus 100 and controls the respective sections of the printing apparatus 100. For example, when receiving, from the host computer, a print command providing a printing instruction or a cut command providing a cutting instruction, the control section 300 controls operation of the printing section 70 to transport the thermal paper S and perform printing thereon and then causes the cutter mechanism 20 to cut the thermal paper S. Note that the control section 300 may include a communication section such as a communication interface and may be configured to receive a command through the communication section.

1-2. Configuration of Cutter Mechanism

The cutter mechanism 20 is provided upstream of the paper discharge port 30 in the transport direction of the thermal paper S and causes a movable blade 21 and a fixed blade 27 to cut the thermal paper S on which printing has been performed by the thermal head 10. The movable blade 21 is attached on the main body frame 60 side and the fixed blade 27 is attached on the cover frame 12 side. Note that the movable blade 21 and the fixed blade 27 are examples of a first blade and a second blade, respectively. The movable blade 21 may be attached on the cover frame 12 side and the fixed blade 27 may be attached on the main body frame 60 side. The present embodiment describes an example in which the movable blade 21 is attached on the main body frame 60 side and the fixed blade 27 is attached on the cover frame 12 side.

The movable blade 21 and a driving mechanism 22 that drives the movable blade 21 are stored in a first cutter cover 24 provided on the main body frame 60 side. On the other hand, the fixed blade 27 is stored in a second cutter cover 29 provided on the cover frame 12 side. The fixed blade 27 is provided at a position facing the movable blade 21 with the transport path D therebetween. Note that the first cutter cover 24 and the second cutter cover 29 are not necessarily required. The present embodiment describes an example in which the first cutter cover 24 is provided on the main body frame 60 side and the second cutter cover 29 is provided on the cover frame 12 side.

When the cover frame 12 is opened to set the paper roll R in the paper roll holder 16, the fixed blade 27 moves together with the cover frame 12 and is away from the movable blade 21. In this state, the paper roll R is set in the paper roll holder 16. Then, the thermal paper S that is drawn out from the paper roll R is caused to pass between the movable blade 21 and the fixed blade 27 and the cover frame 12 is closed. Thereby, the thermal paper S is disposed between the movable blade 21 and the fixed blade 27.

The movable blade 21 is driven by the driving mechanism 22 to be reciprocated between a standby position and a cutting position. The movable blade 21 moves from the standby position to the cutting position to cut the thermal paper S. After cutting the thermal paper S, the movable blade 21 moves from the cutting position to the standby position to expose the transport path D and enables the thermal paper S to be transported.

Figure 2:
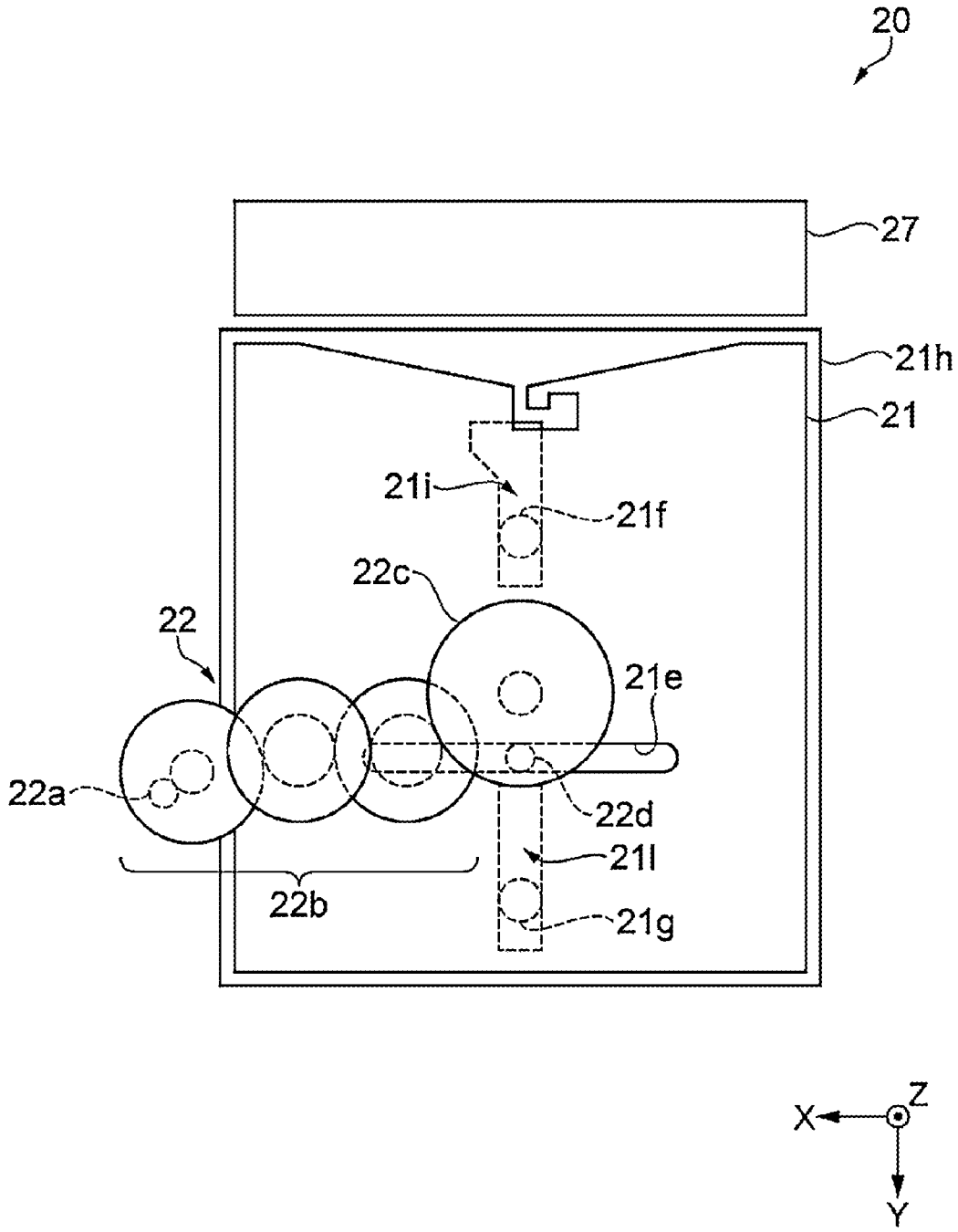
FIG. 2 is a plan view of main parts of a driving mechanism.

FIG. 2 is a plan view of main parts of the driving mechanism 22. Note that, in the following drawings, reference symbol X denotes the right-left direction, reference symbol Y denotes the front-rear direction, and reference symbol Z denotes the up-down direction. Here, the direction indicated by the arrow denoted by reference symbol X is the leftward direction, the direction indicated by the arrow denoted by reference symbol Y is the frontward direction, and the direction indicated by the arrow denoted by reference symbol Z is the upward direction. Further, the right-left direction in the following drawings indicates the width direction of each of the printing apparatus 100, the movable blade 21, and the fixed blade 27.

The driving mechanism 22 includes a motor (not illustrated), a gear 22*a* that is a rotational shaft of the motor, a gear train 22*b* that is coupled to the gear 22*a* to transfer rotation of the gear 22*a*, and a driven gear 22*c* that is coupled to the gear train 22*b* to rotate. The motor is, for example, a stepping motor or a DC motor and drives the gear 22*a* in accordance with control of the control section 300. The gear 22*a* is driven by the motor to rotate in a right-handed or left-handed direction. In other words, the gear 22*a* rotates clockwise or counterclockwise. The motor is installed to stand vertically in the Z direction in the main body case 201, and the gear 22*a* and the gear train 22*b* are coupled. Note that the motor is not limited to being installed to stand vertically and may be installed in another state. Moreover, the gear 22*a* includes, for example, a worm gear.

The gear train 22*b* includes a plurality of gears that transfer rotation of the gear 22*a* to the driven gear 22*c*. The gear train 22*b* may be, for example, a speed-reducing gear train that reduces the rotational speed of the gear 22*a* and transfers the rotation to the driven gear 22*c*. Further, the gear train 22*b* is not limited to including the plurality of gears and may include one gear. The gear train 22*b* is not necessarily required, and the structure may be such that the gear 22*a* is directly coupled to the driven gear 22*c*. The present embodiment describes, for example, a structure in which the driven gear 22*c* is coupled to the gear 22*a* via the gear train 22*b*.

The driven gear 22*c* is a gear that is rotated by the gear 22*a* and the gear train 22*b* and has a crank pin 22*d* disposed on the surface facing the movable blade 21. The crank pin 22*d* is coupled to a slide groove 21*e* of the movable blade 21, which will be described below, to drive the movable blade 21. When the driven gear 22*c* rotates, the crank pin 22*d* moves along the slide groove 21*e*. Then, the movable blade 21 pushed by the crank pin 22*d* is reciprocated between the standby position and the cutting position. Note that the driven gear 22*c* is an example of a first rotating body. The first rotating body is not limited to a gear and may be a cam or the like. As an example of the first rotating body in the present embodiment, the driven gear 22*c* will be described.

Figure 3A:
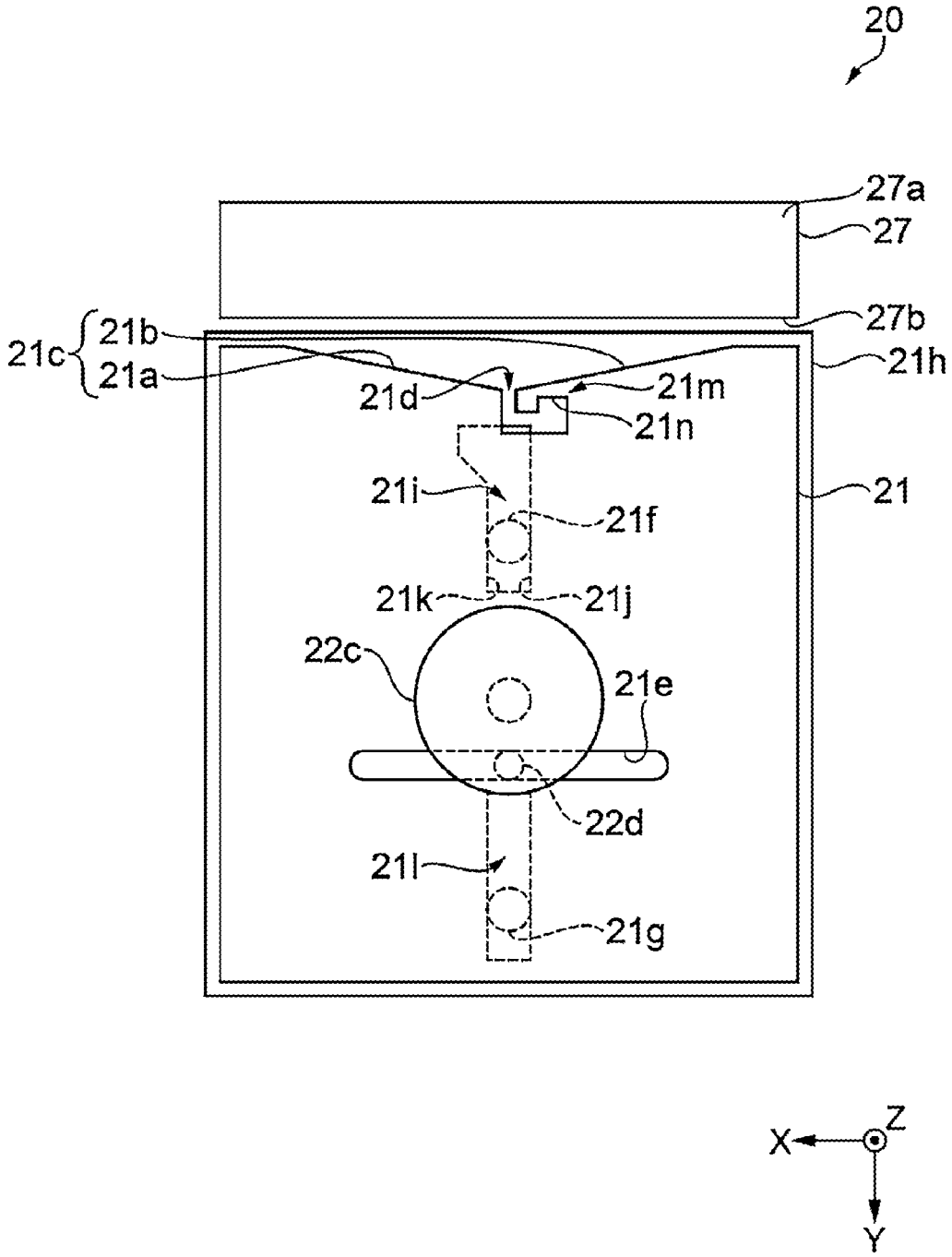
FIG. 3A is a plan view of main parts of a movable blade according to a first embodiment.

FIG. 3A is a plan view of main parts of the movable blade 21 and the fixed blade 27.

The movable blade 21 is formed from, for example, a plate member made of metal and has a V-shaped cutting edge 21*c* that faces the fixed blade 27. The V-shaped cutting edge 21*c* is the rearward end of the movable blade 21 in the Y direction of the printing apparatus 100. The V-shaped cutting edge 21*c* is an example of a blade section. The V-shaped cutting edge 21*c* is a cutter blade having a V-shape obtained by combining a left cutting edge 21*a* and a right cutting edge 21*b* with both ends of the movable blade 21 in the width direction closest to the fixed blade 27 and the center portion in the width direction furthest from the fixed blade 27. The cutting edge 21*a* and the cutting edge 21*b* are disposed with a gap therebetween in the center of the movable blade 21 in the width direction. The gap serves as a notch section 21*d*. In the movable blade 21, the V-shaped cutting edge 21*c* is a region in which the thermal paper S is cut and the notch section 21*d* is a region in which an uncut portion of the thermal paper S is formed. Note that the V-shaped cutting edge 21*c* is not required to have a V-shape in a strict sense and is required only to have a configuration in which the left cutting edge 21*a* and the right cutting edge 21*b* are coupled at a certain angle via the notch section 21*d*. Moreover, the notch section 21*d* is not limited to being provided in the center of the movable blade 21 in the width direction and may be provided at a position shifted from the center. The left cutting edge 21*a* and the right cutting edge 21*b* are not limited to being linear in shape and may have a partially curved shape or the like. The V-shaped cutting edge 21*c* is an example of a first cutting edge.

The movable blade 21 may have an angled structure 21*m*. The angled structure 21*m* is a structure that has a claw shape and that is provided in the left-side end of the right cutting edge 21*b* in the X direction. However, the angled structure 21*m* may be provided in the right-side end of the left cutting edge 21*a* in the X direction. The angled structure 21*m* is formed in the movable blade 21 by a portion of the notch section 21*d* that extends frontward in the Y direction, a portion thereof that extends in the X direction, and a portion thereof that extends rearward in the Y direction. In other words, the angled structure 21*m* is formed in the movable blade 21 by the notch section 21*d* that is bent at a certain position. Alternatively, as is the case with the right cutting edge 21*b*, the angled structure 21*m* is formed in the movable blade 21 so as to include a protruding portion that protrudes frontward in the Y direction from the left-side end of the right cutting edge 21*b* in the X direction.

A tip portion of the angled structure 21*m* is formed by a recess which includes the portion of the notch section 21*d* that extends rearward in the Y direction. In the tip portion, an end extending in the X direction, which corresponds to an end opposite to an end provided frontward in the Y direction, is defined as a cutting end 21*n*. Note that the angled structure 21*m* is not limited to being provided in the end of the left cutting edge 21*a* or the end of the right cutting edge 21*b* and may be provided at a position shifted from the center. The angled structure 21*m* may have a structure formed only by a portion of the notch section 21*d* that extends frontward in the Y direction and a portion thereof that extends in the X direction. In this case, the recess of the angled structure 21*m* is a recess that includes the portion extending in the X direction. Regarding the ends of the recess of the angled structure 21*m* that extend in the X direction, an end opposite to an end provided frontward in the Y direction is defined as the cutting end 21*n*. The cutting end 21*n* may have a cutting edge similar to the left cutting edge 21*a* or the right cutting edge 21*b* of the movable blade 21. The movable blade 21 is not required to have the angled structure 21*m*. For example, the movable blade 21 may have the notch section 21*d* formed only by a portion extending frontward in the Y direction. As an example in the present embodiment, the movable blade 21 having the angled structure 21*m* will be described.

The movable blade 21 includes the slide groove 21*e* that is a linear groove extending in the X direction and having both ends of an arc shape. The slide groove 21*e* is coupled to the crank pin 22*d* of the driven gear 22*c*. Thus, the slide groove 21*e* width in the Y direction is larger than the crank pin 22*d* width in the Y direction. The slide groove 21*e* may be in direct contact with the crank pin 22*d* or may be in indirect contact with the crank pin 22*d* via another member. For example, the structure may be such that a guiding member of the crank pin 22*d* is attached to the slide groove 21*e*, the guiding member and the crank pin 22*d* are brought into direct contact with each other, and the slide groove 21*e* and the crank pin 22*d* are brought into indirect contact with each other via the guiding member. The slide groove 21*e* width in the X direction is desirably larger than the diameter of the driven gear 22*c*. Moreover, the center of the slide groove 21*e* in the X direction is desirably on the line that passes through the center of the movable blade 21 in the X direction and that extends in the Y direction. In other words, the center of the slide groove 21*e* is desirably on the center line of the movable blade 21. The shape of the slide groove 21*e* is not limited to the shape having both ends in the arc shape and may be, for example, a rectangular shape.

The movable blade 21 includes guide shafts 21*f* and 21*g*. The guide shafts 21*f* and 21*g* are desirably positioned on the center line in the X direction of the movable blade 21. The guide shafts 21*f* and 21*g*, which correspond to metal pins of a cylindrical shape, protrude downward in the Z direction and are coupled respectively to guide grooves 21*i* and 21*l* of a plate 21*h* described later. When the movable blade 21 is reciprocated between the standby position and the cutting position, the guide shafts 21*f* and 21*g* respectively change the positions with respect to the guide grooves 21*i* and 21*l*. More specifically, the guide shafts 21*f* and 21*g* move respectively along the guide grooves 21*i* and 21*l*. Note that the shape of the guide shafts 21*f* and 21*g* is not limited to a cylindrical shape and may be a shape such as a square column or hexagonal column. One of the guide shafts 21*f* and 21*g* may be larger than the other. Moreover, the number of guide shafts of the present embodiment is two but may be one. The guide shafts 21*f* and 21*g* are not required to be made of metal and may be made of a resin such as plastic. The guide shafts 21*f* and 21*g* may be referred to respectively as a first guide shaft and a second guide shaft.

The movable blade 21 is placed on the plate 21*h* provided below the movable blade 21 in the Z direction and is able to slide on the plate 21*h*. The plate 21*h* is formed from, for example, a metal plate member and supports the movable blade 21. The plate 21*h* has the guide grooves 21*i* and 21*l*. The guide grooves 21*i* and 21*l* are grooves extending in the Y direction and are coupled respectively to the guide shafts 21*f* and 21*g* of the movable blade 21. Thus, the widths of the guide grooves 21*i* and 21*l* in the X direction are respectively larger than the widths of the guide shafts 21*f* and 21*g* in the X direction. The guide groove 21*i* has a first side 21*j* disposed on the right side of the guide shaft 21*f* of the movable blade 21 in the X direction and a second side 21*k* disposed on the left side thereof in the X direction. The first side 21*j* and the second side 21*k* are sides used for the guide shaft 21*f* to be guided and are side portions of the guide groove 21*i*. The first side 21*j* extends in the Y direction. In the second side 21*k*, a portion facing the first side 21*j* and extending in the Y direction is provided frontward in the Y direction and a portion extending in the direction away from the first side 21*j* is provided rearward in the Y direction. The portion facing the first side 21*j* and extending in the Y direction may be referred to as a first portion and the portion extending in the direction away from the first side 21*j* may be referred to as a second portion. The direction away from the first side 21*j* is a direction in which a distance in the X direction between the first side 21*j* and the second side 21*k* increases with respect to the Y direction and is a direction in which the guide groove 21*i* width in the X direction increases. In other words, the direction is a direction in which the guide groove 21*i* widens in the width direction of the movable blade 21. The dimension of the first portion in the Y direction may be longer or shorter than the dimension of the second portion in the Y direction. Alternatively, the dimension of the first portion in the Y direction may be the same as the dimension of the second portion in the Y direction. In addition, the second side 21*k* may have no first portion.

One of the guide grooves 21*i* and 21*l* may be larger than the other in accordance with the guide shaft 21*f* or 21*g*. Further, the number of guide grooves of the present embodiment is two but may be one. The guide grooves 21*i* and 21*l* may be referred to respectively as a first guide groove and a second guide groove.

The fixed blade 27 is formed from, for example, an elongated plate member made of metal and includes a cutting edge 27*b* facing the movable blade 21. The cutting edge 27*b* has a linear shape. The movable blade 21 moves to the cutting position by riding over an upper surface 27*a* of the fixed blade 27 and cuts the thermal paper S by pinching the thermal paper S between the V-shaped cutting edge 21*c* and the cutting edge 27*b*. Here, the notch section 21*d* has no V-shaped cutting edge 21*c* and thus does not cut the thermal paper S. Accordingly, the notch section 21*d* forms an uncut portion of the thermal paper S. Note that the fixed blade 27 is not limited to being linear in shape and may have a partially curved shape or the like. The movable blade 21 may move diagonally upward in the Z direction by riding over the fixed blade 27. Alternatively, while the fixed blade 27 is pushed by the movable blade 21 and sinks downward in the Z direction, the movable blade 21 itself may move in a straight line.

Figure 3B:
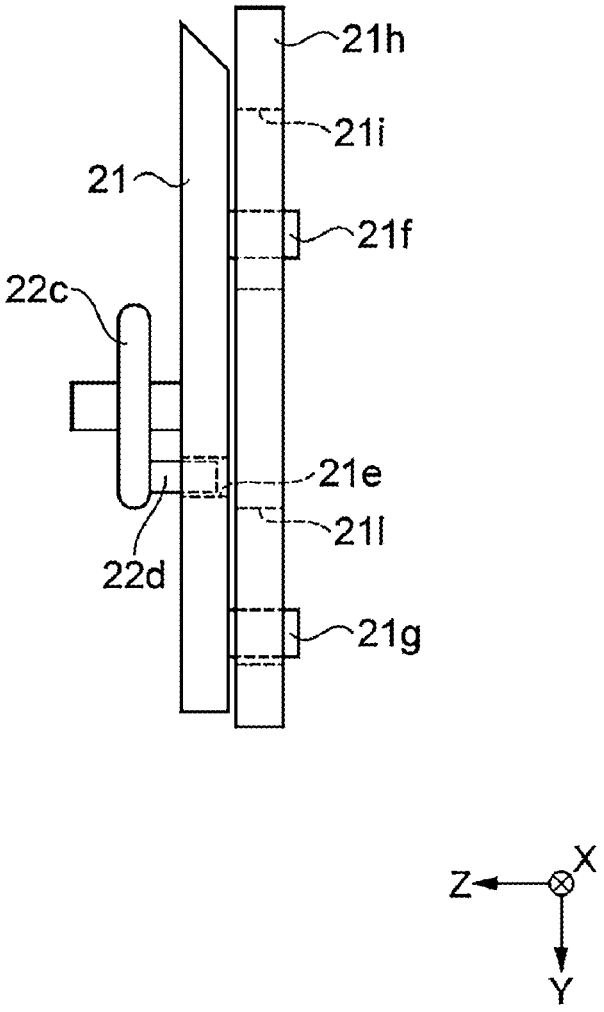
FIG. 3B is a side view of the main parts of the movable blade according to the first embodiment.

FIG. 3B is a side view of main parts of the movable blade 21.

The driven gear 22*c* is provided above the movable blade 21 in the Z direction, and the plate 21*h* is provided below the movable blade 21 in the Z direction. When the driven gear 22*c* rotates, the crank pin 22*d* moves along the slide groove 21*e*. In accordance with the movement of the crank pin 22*d*, the guide shafts 21*g* and 21*f* of the movable blade 21 are guided by the guide grooves 21*i* and 21*l* to move. A shaft portion of the driven gear 22*c*, which is in contact with the movable blade 21, may be provided with an urging member that urges the movable blade 21 downward in the Z direction. The urging member enables the movable blade 21 to move with a stable orientation. Note that a positional relationship between the movable blade 21, the driven gear 22*c*, and the plate 21*h* in the Z direction is not limited to the aforementioned relationship. For example, the driven gear 22*c* may be provided below the movable blade 21 and the plate 21*h* in the Z direction.

1-3. Operation of Cutter Mechanism

The printing apparatus 100 acquires a print command or a cut command from the host computer (not illustrated), transports the thermal paper S by using the platen 71, causes the printing section 70 to perform printing, and causes the cutter mechanism 20 to cut the thermal paper S. In the present embodiment, the cutter mechanism 20 is able to cut the thermal paper S by performing partial cutting in which a portion of the thermal paper S remains uncut or full cutting in which the thermal paper S is completely cut. The cutter mechanism 20 is able to switch between the partial cutting and the full cutting in accordance with a rotational direction of the driven gear 22*c*. For example, when the driven gear 22*c* rotates in the right-handed direction, the movable blade 21 of the cutter mechanism 20 performs the partial cutting of the thermal paper S, and when the driven gear 22*c* rotates in the left-handed direction, the movable blade 21 performs the full cutting of the thermal paper S. The operation of the cutter mechanism 20 performing the partial cutting or the full cutting will be described below. Note that the rotation of the driven gear 22*c* in the right-handed direction and the rotation thereof in the left-handed direction are examples of a first rotational direction and a second rotational direction, respectively.

Figure 4A:
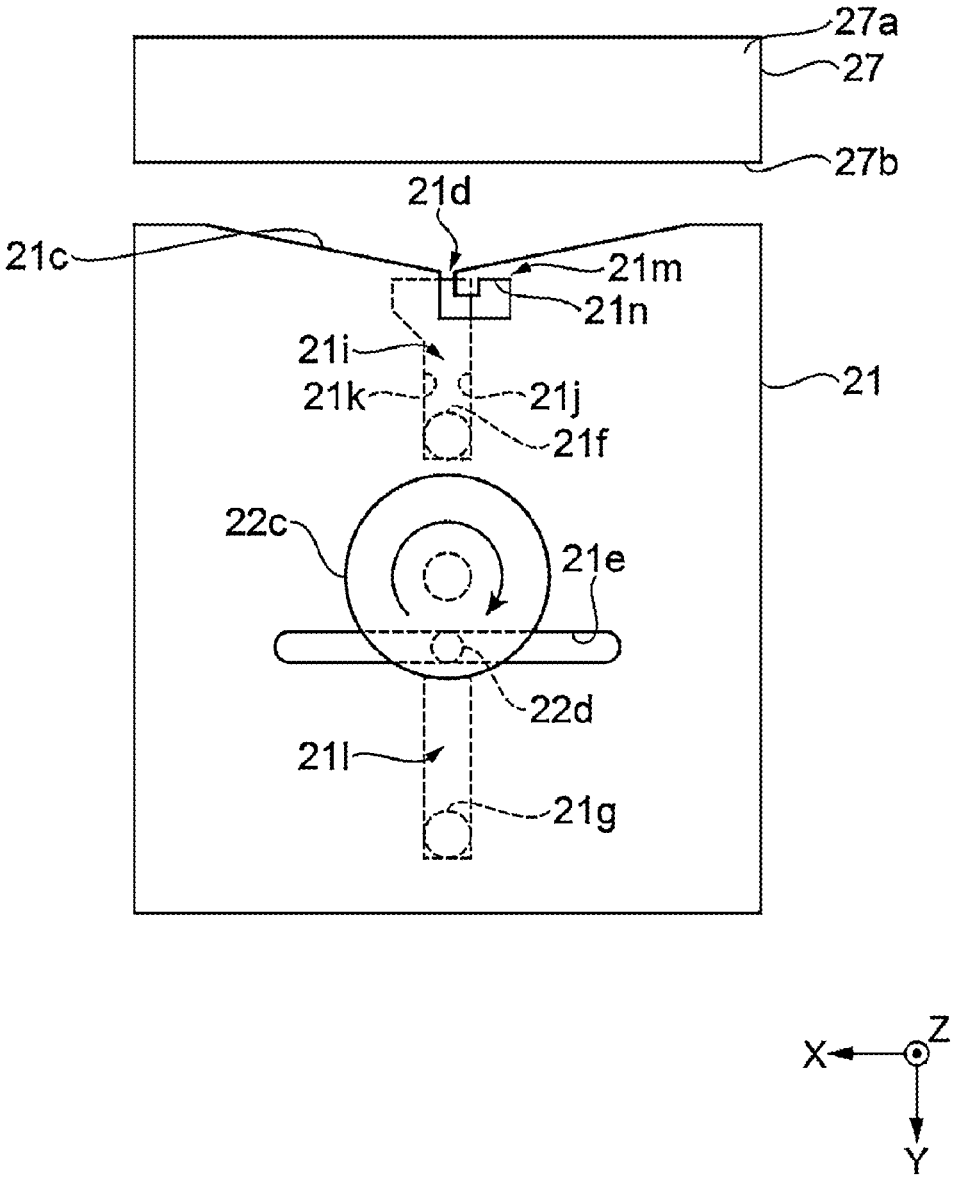
FIG. 4A illustrates transition of the movable blade according to the first embodiment.
Figure 4B:
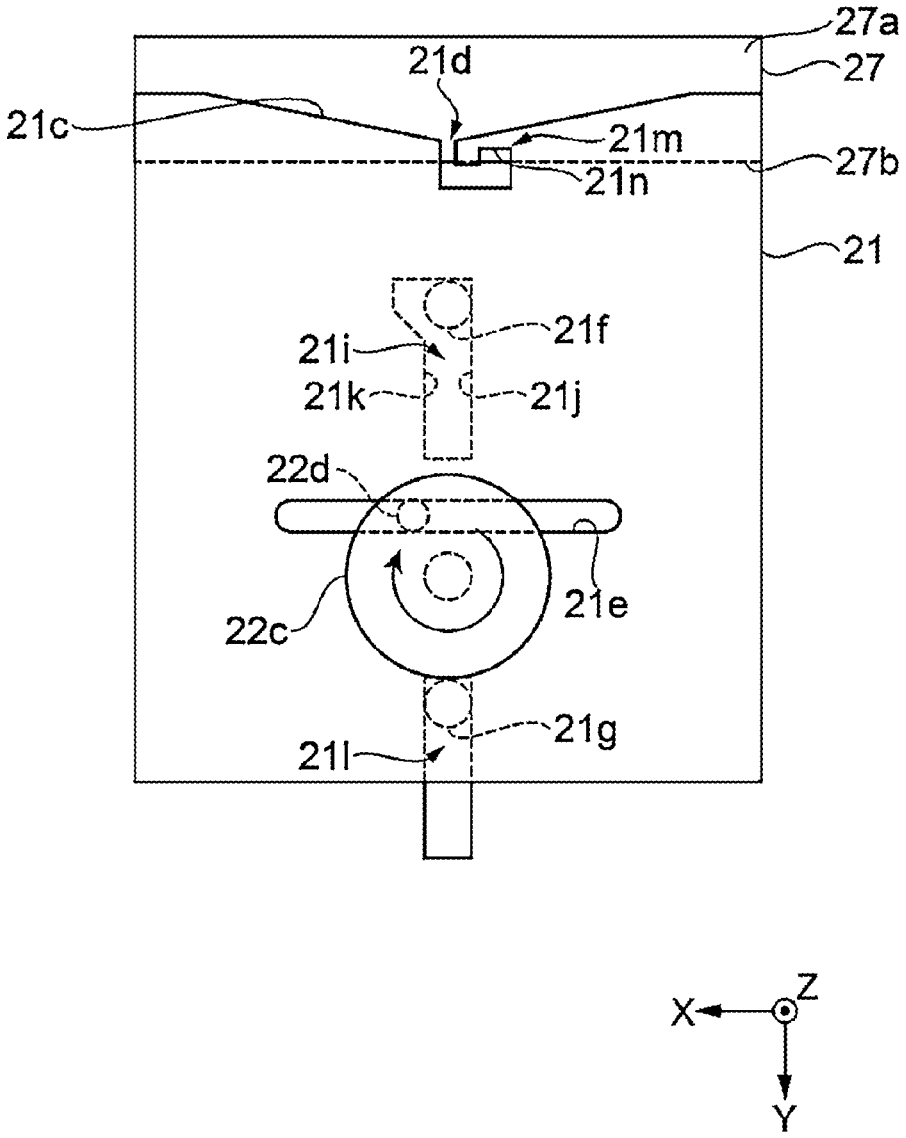
FIG. 4B illustrates transition of the movable blade according to the first embodiment.
Figure 4C:
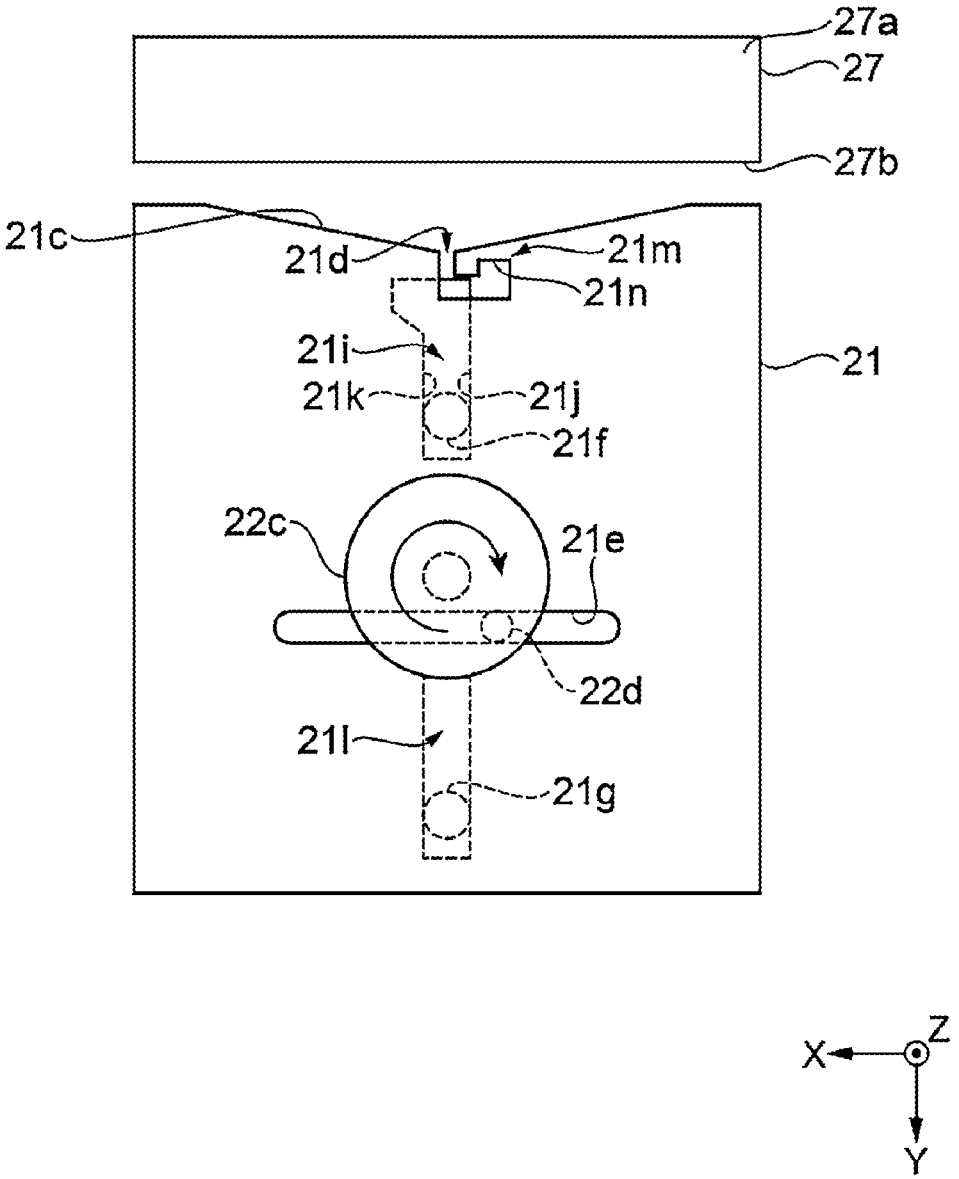
FIG. 4C illustrates transition of the movable blade according to the first embodiment.

FIGS. 4A to 4C illustrate transition of the movable blade 21. In FIGS. 4A to 4C, an example in which the driven gear 22*c* rotates in the first rotational direction will be described. FIG. 4A is a plan view of the main parts when the movable blade 21 is at the standby position, FIG. 4B is a plan view of the main parts when the movable blade 21 is at the cutting position, and FIG. 4C is a plan view of the main parts when the movable blade 21 moves from the cutting position to the standby position. Note that, in FIGS. 4A to 4C, regarding the plate 21*h*, the guide grooves 21*i* and 21*l* are illustrated and illustration of exterior shape is omitted.

In FIG. 4A, the movable blade 21 is at the standby position. The crank pin 22*d* and the guide shafts 21*f* and 21*g* are arranged side by side along the line in the Y direction and are each positioned frontward in the Y direction. The guide shafts 21*f* and 21*g* are respectively on the front sides of the guide grooves 21*i* and 21*l* in the Y direction. When the driven gear 22*c* rotates in the first rotational direction, the crank pin 22*d* moves, in the first rotational direction, rearward in the Y direction. During the movement, the crank pin 22*d* moves, along the slide groove 21*e*, leftward in the X direction and then rightward in the X direction. In other words, the crank pin 22*d* moves leftward in the X direction so as to follow a mountain-like curve. The movable blade 21 is pushed by the crank pin 22*d* moving along the slide groove 21*e* and moves rearward in the Y direction so as to reach the cutting position. Then, the guide shafts 21*f* and 21*g* move, respectively along the guide grooves 21*i* and 21*l*, rearward in the Y direction in accordance with the movement of the movable blade 21.

In FIG. 4B, the movable blade 21 cuts the thermal paper S. The crank pin 22*d* moves, in the first rotational direction, rearward in the Y direction and the movable blade 21 reaches the cutting position. Until reaching the cutting position, the movable blade 21 receives a force from the crank pin 22*d* urging movement in the X direction. In particular, while the crank pin 22*d* moves, along the slide groove 21*e*, rightward in the X direction, the movable blade 21 receives, via the slide groove 21*e*, the force from the crank pin 22*d* urging rightward movement in the X direction. In other words, at least when the crank pin 22*d* is moving, along the slide groove 21*e*, rightward in the X direction, the movable blade 21 moves toward the cutting position while being pushed by the crank pin 22*d* rightward in the X direction.

Since the movable blade 21 is pushed by the crank pin 22*d* rightward in the X direction, the guide shaft 21*f* of the movable blade 21 is in contact with the first side 21*j* of the guide groove 21*i* on the right side in the X direction. Then, the guide shaft 21*f* moves, along the first side 21*j*, rearward in the Y direction of the guide groove 21*i*. Note that the guide shaft 21*f* may be in direct contact with the first side 21*j* or may be in indirect contact with the first side 21*j* via another member. In other words, the guide shaft 21*f* is required only to move along the first side 21*j*. Since the first side 21*j* is a side extending in the Y direction, the movable blade 21 is guided by the first side 21*j* to move rearward in the Y direction and cuts the thermal paper S. More specifically, the V-shaped cutting edge 21*c* of the movable blade 21 cuts the thermal paper S and the notch section 21*d* of the movable blade 21 forms an uncut portion of the thermal paper S. The direction in which the movable blade 21 cuts the thermal paper S, which corresponds to rearward in the Y direction, is defined as a cutting direction.

In FIG. 4C, the movable blade 21 returns to the standby position. The crank pin 22*d* moves, in the first rotational direction, from rearward to frontward in the Y direction. During the movement, the crank pin 22*d* moves, along the slide groove 21*e*, rightward in the X direction and then leftward in the X direction. In other words, the crank pin 22*d* moves rightward in the X direction so as to follow a mountain-like curve. The movable blade 21 is pushed by the crank pin 22*d* moving along the slide groove 21*e* and moves frontward in the Y direction so as to reach the standby position.

Until returning to the standby position, the movable blade 21 receives the force from the crank pin 22*d* urging movement in the X direction. In particular, while the crank pin 22*d* moves, along the slide groove 21*e*, rightward in the X direction, the movable blade 21 receives, via the slide groove 21*e*, the force from the crank pin 22*d* urging rightward movement in the X direction. In other words, at least when the crank pin 22*d* is moving, along the slide groove 21*e*, rightward in the X direction, the movable blade 21 moves toward the standby position while being pushed by the crank pin 22*d* rightward in the X direction. Since the movable blade 21 is pushed by the crank pin 22*d* rightward in the X direction, the guide shaft 21*f* of the movable blade 21 is in contact with the first side 21*j* of the guide groove 21*i* on the right side in the X direction. Then, the guide shaft 21*f* moves, along the first side 21*j*, frontward in the Y direction of the guide groove 21*i*. Since the first side 21*j* is a side extending in the Y direction, the movable blade 21 is guided by the first side 21*j* to move frontward in the Y direction and moves toward the standby position while being away from the thermal paper S that is cut. Since the movable blade 21 is guided by the first side 21*j* until the movable blade 21 cuts the thermal paper S and is away from the thermal paper S, the movable blade 21 moves in the cutting direction and in the direction opposite to the cutting direction. According to such a configuration, the movable blade 21 performs the partial cutting in which a portion of the thermal paper S remains uncut. In other words, when the driven gear 22*c* rotates in the first rotational direction, the movable blade 21 performs the partial cutting.

Figure 5A:
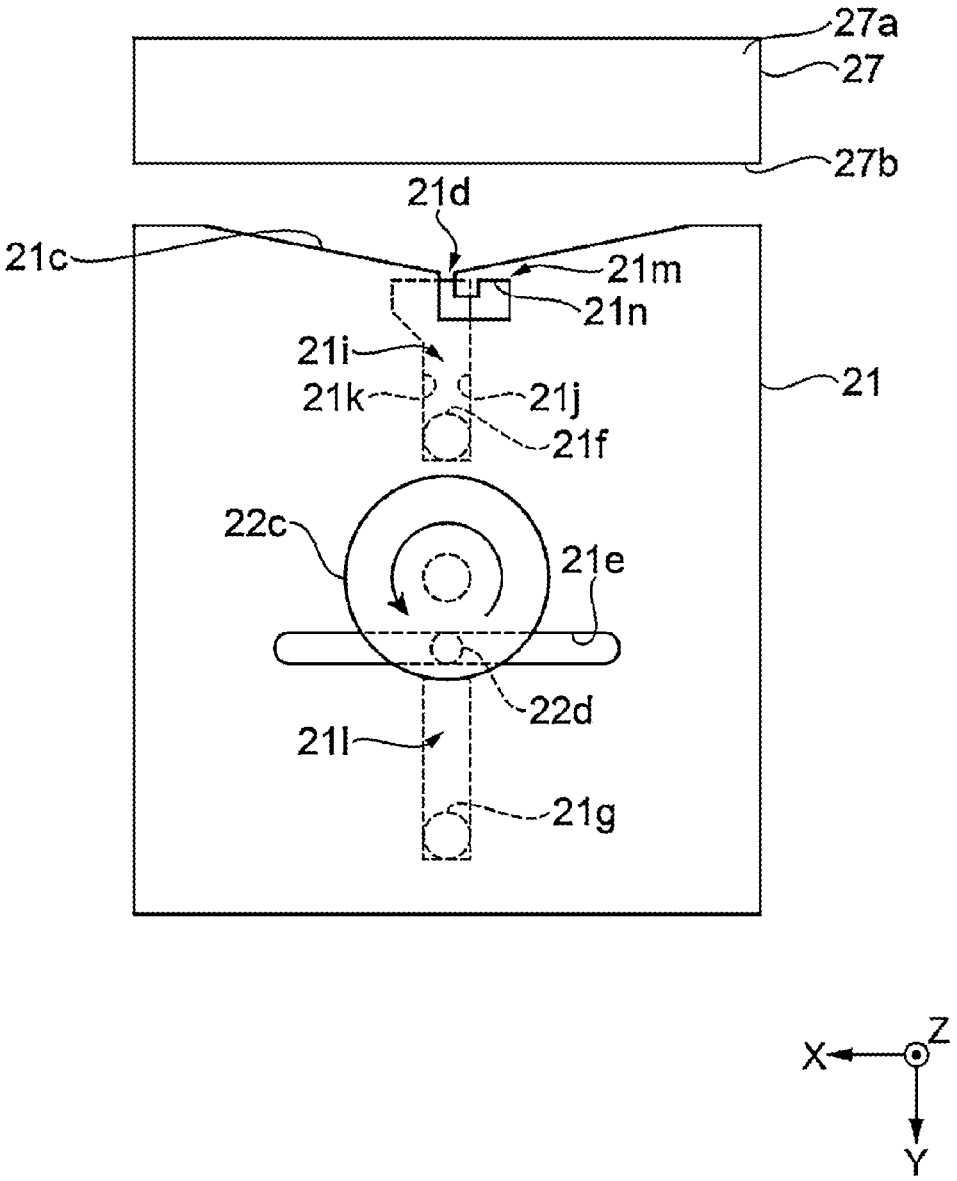
FIG. 5A illustrates transition of the movable blade according to the first embodiment.
Figure 5B:
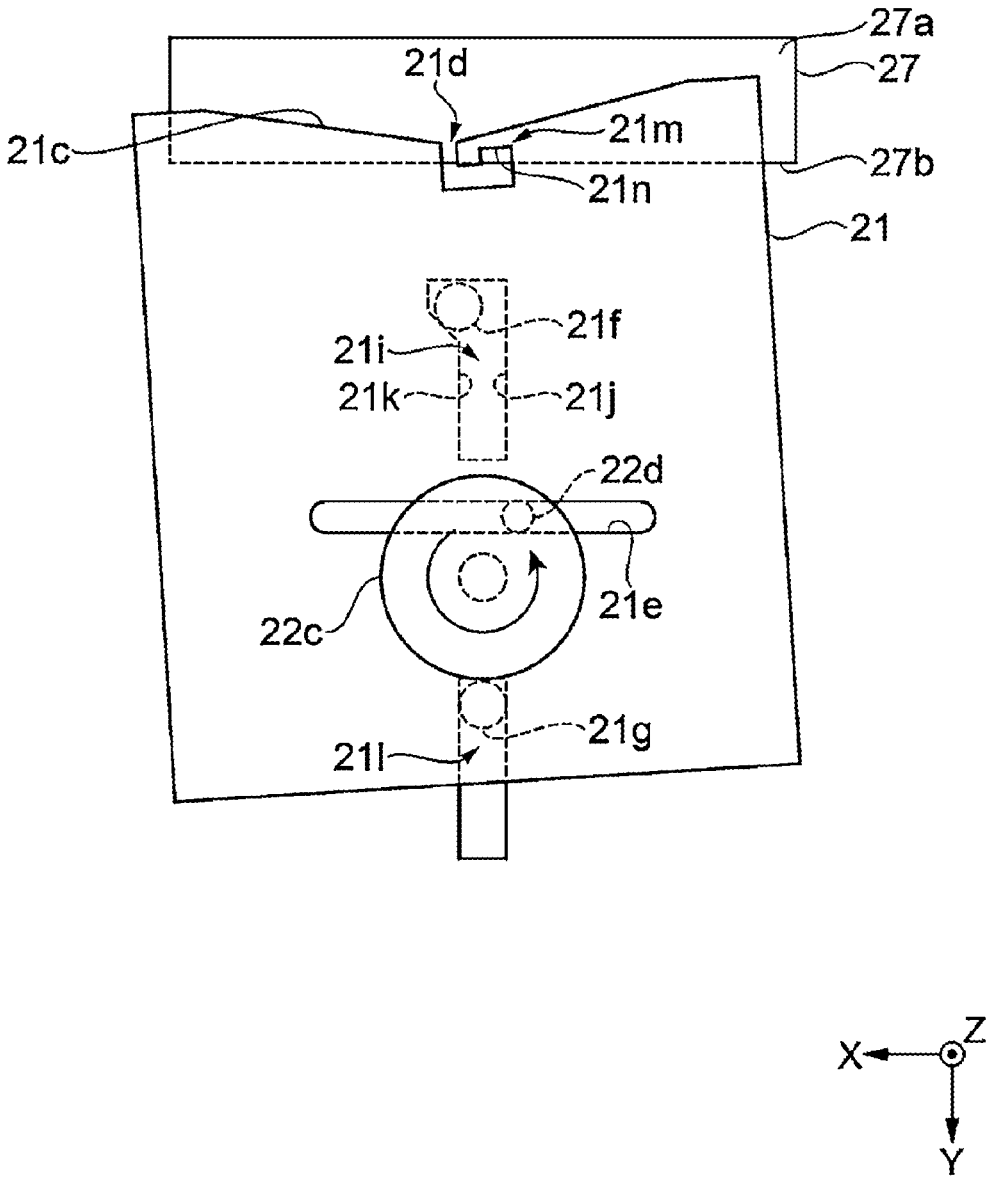
FIG. 5B illustrates transition of the movable blade according to the first embodiment.
Figure 5C:
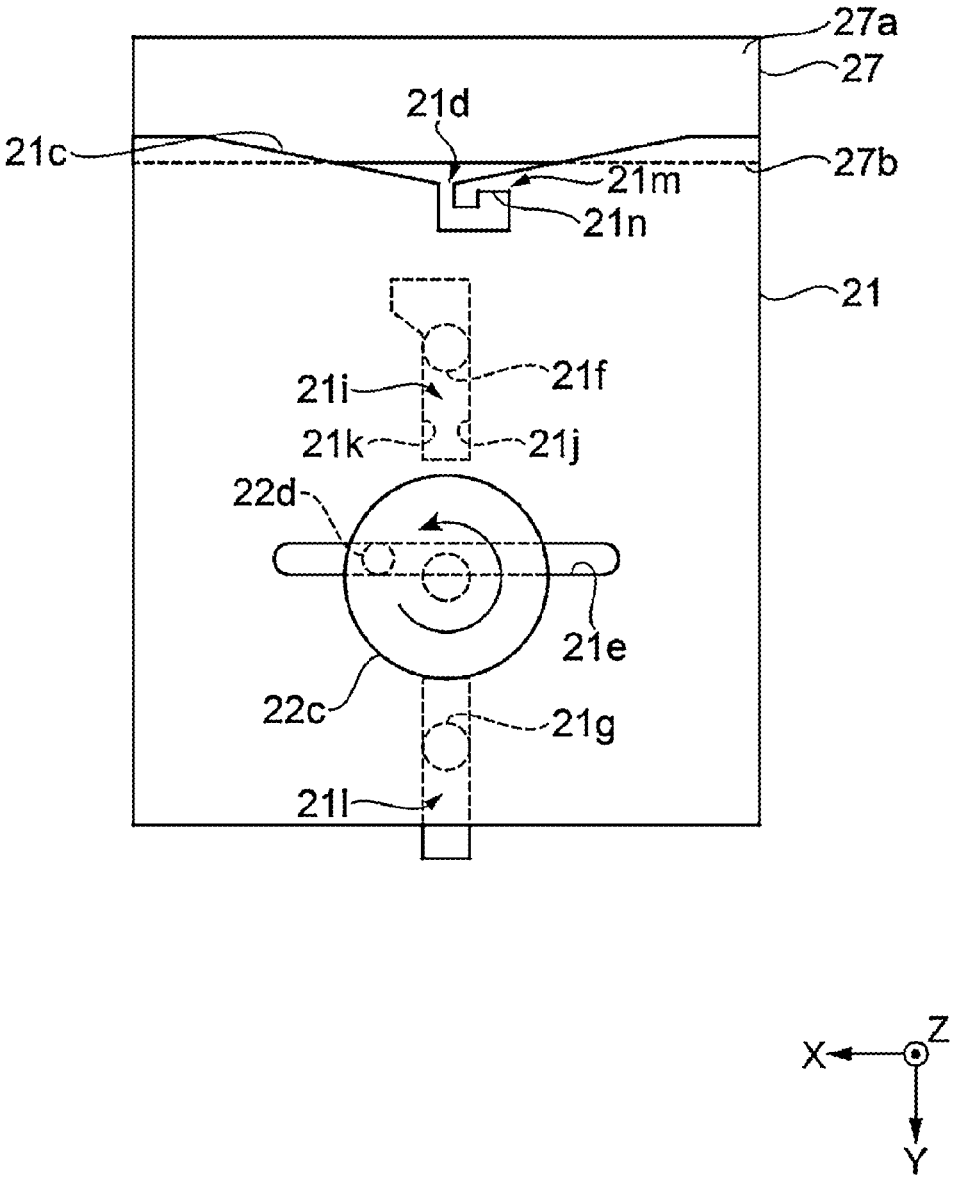
FIG. 5C illustrates transition of the movable blade according to the first embodiment.

FIGS. 5A to 5C illustrate transition of the movable blade 21. In FIGS. 5A to 5C, an example in which the driven gear 22*c* rotates in the second rotational direction will be \described. FIG. 5A is a plan view of the main parts when the movable blade 21 is at the standby position, FIG. 5B is a plan view of the main parts when the movable blade 21 is at the cutting position, and FIG. 5C is a plan view of the main parts when the movable blade 21 moves from the cutting position to the standby position. Note that, in FIGS. 5A to 5C, regarding the plate 21*h*, the guide grooves 21*i* and 21*l* are illustrated and illustration of exterior shape is omitted.

In FIG. 5A, the movable blade 21 is at the standby position. The crank pin 22*d* and the guide shafts 21*f* and 21*g* are arranged side by side along the line in the Y direction and are each positioned frontward in the Y direction. The guide shafts 21*f* and 21*g* are respectively on the front sides of the guide grooves 21*i* and 21*l* in the Y direction. When the driven gear 22*c* rotates in the second rotational direction, the crank pin 22*d* moves, in the second rotational direction, rearward in the Y direction. During the movement, the crank pin 22*d* moves, along the slide groove 21*e*, rightward in the X direction and then leftward in the X direction. In other words, the crank pin 22*d* moves rightward in the X direction so as to follow a mountain-like curve. The movable blade 21 is pushed by the crank pin 22*d* moving along the slide groove 21*e* and moves rearward in the Y direction so as to reach the cutting position. Then, the guide shafts 21*f* and 21*g* move, respectively along the guide grooves 21*i* and 21*l*, rearward in the Y direction in accordance with the movement of the movable blade 21.

In FIG. 5B, the movable blade 21 cuts the thermal paper S. The crank pin 22*d* moves, in the second rotational direction, rearward in the Y direction and the movable blade 21 reaches the cutting position. Until reaching the cutting position, the movable blade 21 receives the force from the crank pin 22*d* urging movement in the X direction. In particular, while the crank pin 22*d* moves, along the slide groove 21*e*, leftward in the X direction, the movable blade 21 receives, via the slide groove 21*e*, the force from the crank pin 22*d* urging leftward movement in the X direction. In other words, at least when the crank pin 22*d* is moving, along the slide groove 21*e*, leftward in the X direction, the movable blade 21 moves toward the cutting position while being pushed by the crank pin 22*d* leftward in the X direction.

Since the movable blade 21 is pushed by the crank pin 22*d* leftward in the X direction, the guide shaft 21*f* of the movable blade 21 is in contact with the second side 21*k* of the guide groove 21*i* on the left side in the X direction. Then, the guide shaft 21*f* moves, along the second side 21*k*, rearward in the Y direction of the guide groove 21*i*. Note that the guide shaft 21*f* may be in direct contact with the second side 21*k* or may be in indirect contact with the second side 21*k* via another member. In other words, the guide shaft 21*f* is required only to move along the second side 21*k*. Since the second side 21*k* includes the first portion and the second portion, the movable blade 21 is guided by the first portion of the second side 21*k* to move in the Y direction and is then guided by the second portion of the second side 21*k* to move in the direction away from the first side 21*j*, which corresponds to the direction inclined with respect to the cutting direction, and cuts the thermal paper S.

By the movable blade 21 moving in the cutting direction, the V-shaped cutting edge 21*c* cuts the thermal paper S and the notch section 21*d* forms an uncut portion of the thermal paper S. After that, by moving in the direction inclined with respect to the cutting direction, the movable blade 21 also cuts the uncut portion of the thermal paper S. Note that the thermal paper S may be cut only by the V-shaped cutting edge 21*c* of the movable blade 21 without an uncut portion of the thermal paper S being formed by the notch section 21*d*. The present embodiment describes an example in which an uncut portion is formed by the notch section 21*d*. Examples of the movable blade 21 moving in the direction inclined with respect to the cutting direction also include the movable blade 21 being inclined or rotating with respect to the cutting direction upon movement of the guide shaft 21*f* along the second portion of the second side 21*k* with the guide shaft 21*g* as a fulcrum.

By moving in the direction inclined with respect to the cutting direction, the movable blade 21 may cut an uncut portion of the thermal paper S by using the widthwise center of the V-shaped cutting edge 21*c*. Alternatively, by hooking an uncut portion of the thermal paper S on the cutting end 21*n* of the angled structure 21*m* when the movable blade 21 moves in the direction inclined with respect to the cutting direction, the uncut portion of the thermal paper S may be cut by being pulled and torn by the cutting end 21*n* when the movable blade 21 moves from the cutting position to the standby position. In this case, the cutting end 21*n* width in the X direction is desirably larger than the notch section 21*d* width in the X direction. Thereby, the cutting end 21*n* width in the X direction is larger than the width of the uncut portion of the thermal paper S in the X direction, resulting in the uncut portion of the thermal paper S being easily hooked on the cutting end 21*n* and the uncut portion of the thermal paper S being able to be more reliably cut.

In FIG. 5C, the movable blade 21 returns to the standby position. The crank pin 22*d* moves, in the second rotational direction, from rearward to frontward in the Y direction. During the movement, the crank pin 22*d* moves, along the slide groove 21*e*, leftward in the X direction and then rightward in the X direction. In other words, the crank pin 22*d* moves leftward in the X direction so as to follow a mountain-like curve. The movable blade 21 is pushed by the crank pin 22*d* moving along the slide groove 21*e* and moves frontward in the Y direction so as to reach the standby position.

Until returning to the standby position, the movable blade 21 receives the force from the crank pin 22*d* urging movement in the X direction. In particular, while the crank pin 22*d* moves, along the slide groove 21*e*, leftward in the X direction, the movable blade 21 receives, via the slide groove 21*e*, the force from the crank pin 22*d* urging leftward movement in the X direction. In other words, at least when the crank pin 22*d* is moving, along the slide groove 21*e*, leftward in the X direction, the movable blade 21 moves toward the standby position while being pushed by the crank pin 22*d* leftward in the X direction. Since the movable blade 21 is pushed by the crank pin 22*d* leftward in the X direction, the guide shaft 21*f* of the movable blade 21 is in contact with the second side 21*k* of the guide groove 21*i* on the left side in the X direction. The guide shaft 21*f* moves, along the second side 21*k*, frontward in the Y direction of the guide groove 21*i*. Since the movable blade 21 is guided by the second side 21*k* until the movable blade 21 cuts the thermal paper S and is away from the thermal paper S, the movable blade 21 moves at least in the direction inclined with respect to the cutting direction and in the direction opposite to the direction inclined with respect to the cutting direction. According to such a configuration, the movable blade 21 performs the full cutting in which the thermal paper S is completely cut. In other words, when the driven gear 22*c* rotates in the second rotational direction, the movable blade 21 performs the full cutting.

2. Second Embodiment

2-1. Configuration of Cutter Mechanism

Next, a cutter mechanism 120 of a second embodiment will be described. Note that description that overlaps the description of the cutter mechanism 20 of the first embodiment will be omitted. Further, components that overlap the components of the cutter mechanism 20 of the first embodiment will be described by using the same reference numerals.

Figure 6:
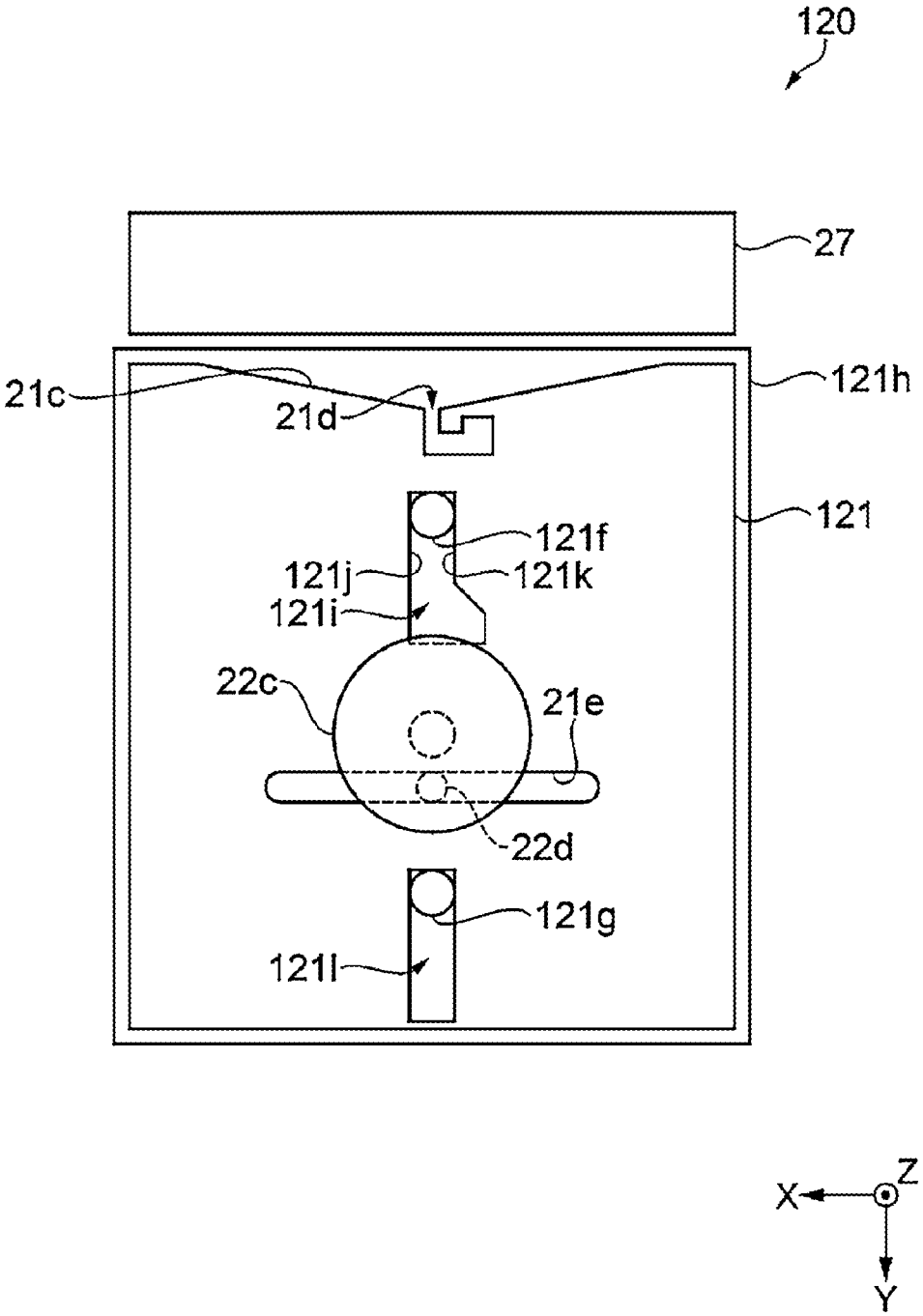
FIG. 6 is a plan view of main parts of a movable blade according to a second embodiment.

FIG. 6 is a plan view of main parts of a movable blade 121 and the fixed blade 27.

The cutter mechanism 120 includes the movable blade 121. The movable blade 121 is different from that of the first embodiment and includes guide grooves 121*i* and 121*l*. The guide grooves 121*i* and 121*l* are grooves extending in the Y direction and are respectively coupled to guide shafts 121*f* and 121*g* of a plate 121*h* described later. Thus, the widths of the guide grooves 121*i* and 121*l* in the X direction are respectively larger than the widths of the guide shafts 121*f* and 121*g* in the X direction. The guide groove 121*i* has a first side 121*j* disposed on the left side of the guide shaft 121*f* of the plate 121*h* in the X direction and a second side 121*k* disposed on the right side thereof in the X direction. The first side 121*j* and the second side 121*k* are sides used for the guide shaft 121*f* to be guided and are side portions of the guide groove 121*i*. The first side 121*j* extends in the Y direction. In the second side 121*k*, a portion facing the first side 121*j* and extending in the Y direction is provided rearward in the Y direction and a portion extending in the direction away from the first side 121*j* is provided frontward in the Y direction. The portion facing the first side 121*j* and extending in the Y direction may be referred to as a first portion and the portion extending in the direction away from the first side 121*j* may be referred to as a second portion. The dimension of the first portion in the Y direction may be longer or shorter than the dimension of the second portion in the Y direction. Alternatively, the dimension of the first portion in the Y direction may be the same as the dimension of the second portion in the Y direction. In addition, the second side 121*k* may have no first portion.

One of the guide grooves 121*i* and 121*l* may be formed to be larger than the other in accordance with the guide shaft 121*f* or 121*g*. The number of guide grooves of the present embodiment is two but may be one. The guide grooves 121*i* and 121*l* may be referred to respectively as a first guide groove and a second guide groove.

The movable blade 121 is placed on the plate 121*h* provided below the movable blade 121 in the Z direction and is able to slide on the plate 121*h*. The plate 121*h* is different from that of the first embodiment and includes the guide shafts 121*f* and 121*g*. The guide shafts 121*f* and 121*g* are desirably positioned on the center line in the X direction of the plate 121*h*. The guide shafts 121*f* and 121*g*, which correspond to metal pins of a cylindrical shape, protrude upward in the Z direction and are coupled respectively to the guide grooves 121*i* and 121*l* of the movable blade 121. When the movable blade 121 is reciprocated between the standby position and the cutting position, the guide shafts 121*f* and 121*g* respectively change the positions with respect to the guide grooves 121*i* and 121*l*. More specifically, the guide grooves 121*i* and 121*l* move while respectively being in contact with the guide shafts 121*f* and 121*g*. Note that the shape of the guide shafts 121*f* and 121*g* is not limited to the cylindrical shape and may be a shape such as a square column or hexagonal column. One of the guide shafts 121*f* and 121*g* may be larger than the other. Moreover, the number of guide shafts of the present embodiment is two but may be one. The guide shafts 121*f* and 121*g* are not required to be made of metal and may be made of a resin such as plastic.

2-2. Operation of Cutter Mechanism

Operation of the cutter mechanism 120 of the second embodiment will be described. Note that description that overlaps the description of the cutter mechanism 20 of the first embodiment will be omitted. Further, components that overlap the components of the cutter mechanism 20 of the first embodiment will be described by using the same reference numerals.

Figure 7A:
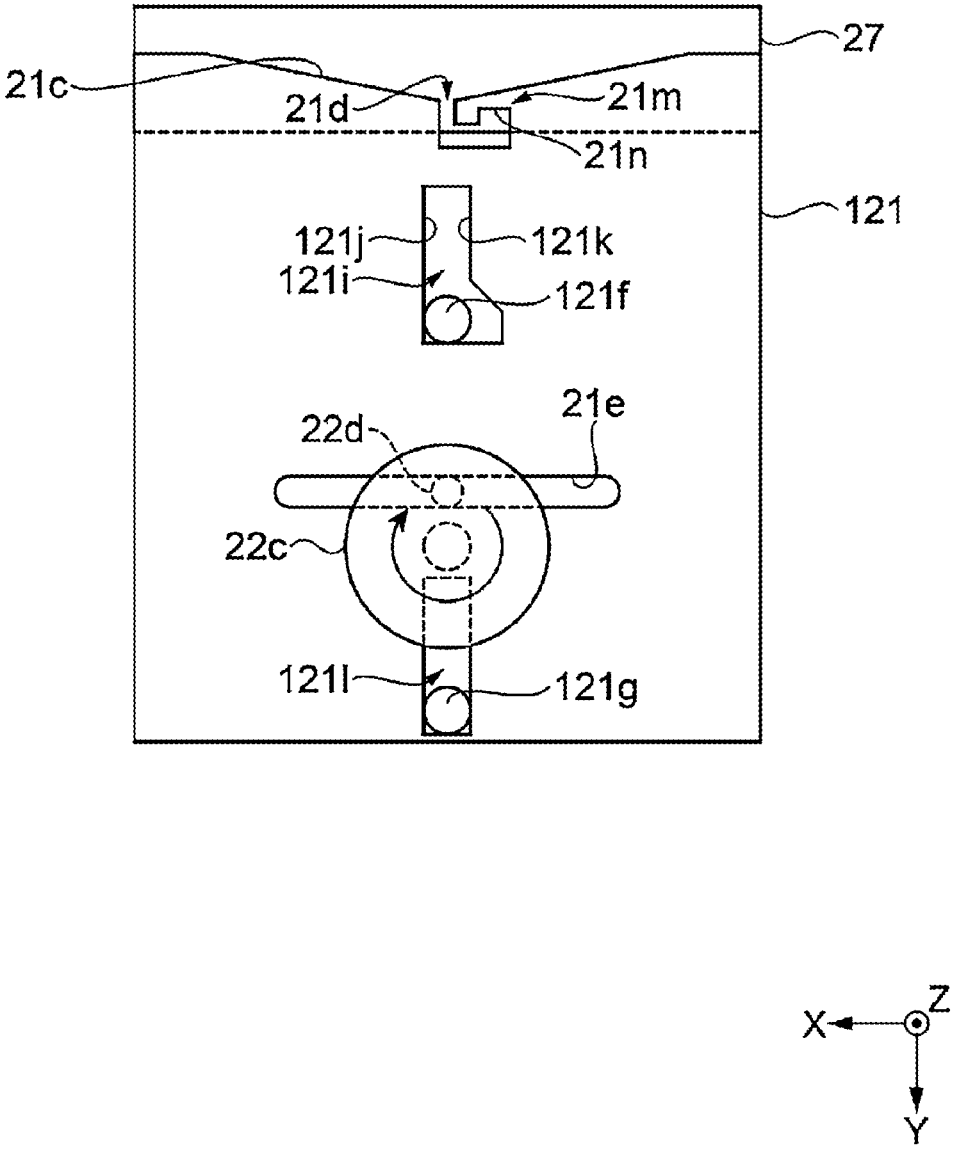
FIG. 7A illustrates transition of the movable blade according to the second embodiment.
Figure 7B:
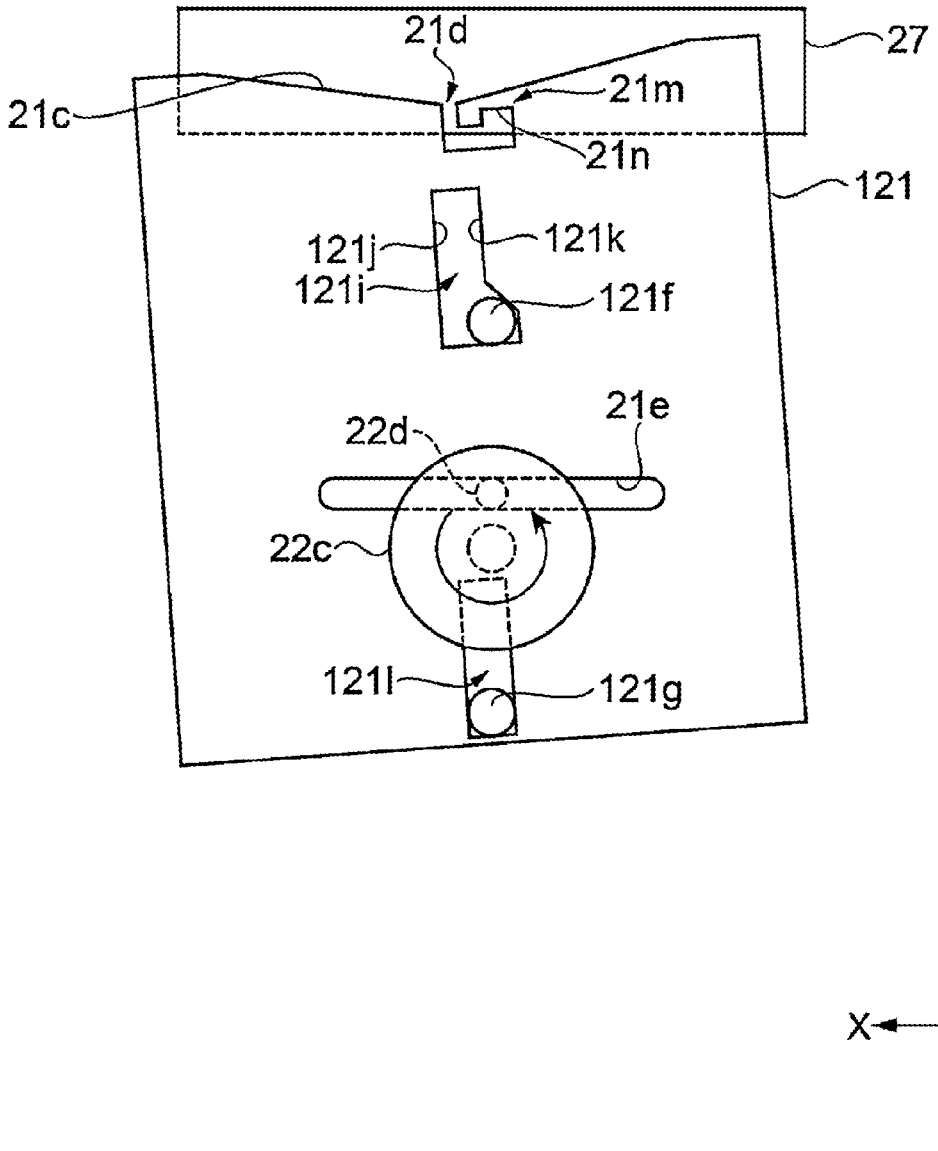
FIG. 7B illustrates transition of the movable blade according to the second embodiment.

FIGS. 7A and 7B are plan views of main parts when the movable blade 121 is at the cutting position. FIG. 7A is a view for explaining the driven gear 22*c* rotating in the first rotational direction and FIG. 7B is a view for explaining the driven gear 22*c* rotating in the second rotational direction. Note that, in FIGS. 7A and 7B, regarding the plate 121*h*, the guide shafts 121*f* and 121*g* are illustrated and illustration of exterior shape is omitted.

In FIG. 7A, when the driven gear 22*c* rotates in the first rotational direction, the movable blade 121 performs the partial cutting. The crank pin 22*d* moves, in the first rotational direction, rearward in the Y direction and the movable blade 121 reaches the cutting position. Until reaching the cutting position, the movable blade 121 receives the force from the crank pin 22*d* urging movement in the X direction. In particular, while the crank pin 22*d* moves, along the slide groove 21*e*, rightward in the X direction, the movable blade 121 receives, via the slide groove 21*e*, the force from the crank pin 22*d* urging rightward movement in the X direction. In other words, at least when the crank pin 22*d* is moving, along the slide groove 21*e*, rightward in the X direction, the movable blade 121 moves toward the cutting position while being pushed by the crank pin 22*d* rightward in the X direction.

Since the movable blade 121 is pushed by the crank pin 22*d* rightward in the X direction, the first side 121*j* of the guide groove 121*i* of the movable blade 121 is in contact with the guide shaft 121*f* on the right side in the X direction. Then, the first side 121*j* moves while being in contact with the guide shaft 121*f*. Note that the first side 121*j* may be in direct contact with the guide shaft 121*f* or may be in indirect contact with the guide shaft 121*f* via another member. Since the first side 121*j* is a side extending in the Y direction, the movable blade 121 is guided by the guide shaft 121*f* via the first side 121*j* to move rearward in the Y direction and cuts the thermal paper S. More specifically, the V-shaped cutting edge 21*c* of the movable blade 121 cuts the thermal paper S and the notch section 21*d* of the movable blade 121 forms an uncut portion of the thermal paper S. When the driven gear 22*c* rotates in the first rotational direction, the movable blade 121 performs the partial cutting.

On the other hand, in FIG. 7B, when the driven gear 22*c* rotates in the second rotational direction, the movable blade 121 performs the full cutting. The crank pin 22*d* moves, in the second rotational direction, rearward in the Y direction and the movable blade 121 reaches the cutting position. Until reaching the cutting position, the movable blade 121 receives the force from the crank pin 22*d* urging movement in the X direction. In particular, while the crank pin 22*d* moves, along the slide groove 21*e*, leftward in the X direction, the movable blade 121 receives, via the slide groove 21*e*, the force from the crank pin 22*d* urging leftward movement in the X direction. In other words, at least when the crank pin 22*d* is moving, along the slide groove 21*e*, leftward in the X direction, the movable blade 121 moves toward the cutting position while being pushed by the crank pin 22*d* leftward in the X direction.

Since the movable blade 121 is pushed by the crank pin 22*d* leftward in the X direction, the second side 121*k* of the guide groove 121*i* of the movable blade 121 is in contact with the guide shaft 121*f* on the left side in the X direction. Then, the second side 121*k* moves while being in contact with the guide shaft 121*f*. Note that the second side 121*k* may be in direct contact with the guide shaft 121*f* or may be in indirect contact with the guide shaft 121*f* via another member. Since the second side 121*k* includes the first portion and the second portion, the movable blade 121 is guided by the guide shaft 121*f* via the first portion to move in the Y direction and then guided by the guide shaft 121*f* via the second portion to move in the direction inclined with respect to the cutting direction and cuts the thermal paper S.

By the movable blade 121 moving in the cutting direction, the V-shaped cutting edge 21*c* cuts the thermal paper S and the notch section 21*d* forms an uncut portion of the thermal paper S. After that, by moving in the direction inclined with respect to the cutting direction, the movable blade 121 also cuts the uncut portion of the thermal paper S. Note that the thermal paper S may be cut only by the V-shaped cutting edge 21*c* of the movable blade 121 without an uncut portion of the thermal paper S being formed by the notch section 21*d*. When the driven gear 22*c* rotates in the second rotational direction, the movable blade 121 performs the full cutting.

As described above, the printing apparatus 100 according to an embodiment to which the disclosure is applied is configured to perform partial cutting in which a portion of the thermal paper S remains uncut and full cutting in which the thermal paper S is completely cut, and the printing apparatus 100 includes: the movable blade 21 or 121; the plate 21*h* or 121*h* configured to support the movable blade 21 or 121; and the driven gear 22*c* that drives the movable blade 21 or 121, in which one of the movable blade 21 or 121 and the plate 21*h* or 121*h* includes the guide groove 21*i* or 121*i*, the other of the movable blade 21 or 121 and the plate 21*h* or 121*h* includes the guide shaft 21*f* or 121*f* configured to be coupled to the guide groove 21*i* or 121*i*, the guide groove 21*i* or 121*i* has the first side 21*j* or 121*j* and the second side 21*k* or 121*k*, the second side 21*k* or 121*k* includes a certain portion that extends in the direction away from the first side 21*j* or 121*j*, when the driven gear 22*c* rotates in the first rotational direction to move the movable blade 21 or 121 toward the thermal paper S, the guide shaft 21*f* or 121*f* changes the position with respect to the guide groove 21*i* or 121*i* along the first side 21*j* or 121*j* and the movable blade 21 or 121 performs the partial cutting, and when the driven gear 22*c* rotates in the second rotational direction different from the first rotational direction to move the movable blade 21 or 121 toward the thermal paper S, the guide shaft 21*f* or 121*f* changes the position with respect to the guide groove 21*i* or 121*i* along the second side 21*k* or 121*k* and the movable blade 21 or 121 performs the full cutting.

According to the printing apparatus 100 of the embodiment, since the guide groove 21*i* or 121*i* includes the first side 21*j* or 121*j* and the second side 21*k* or 121*k* and the second side 21*k* or 121*k* includes the certain portion that extends in the direction away from the first side 21*j* or 121*j*, it is possible to switch between the partial cutting and the full cutting by the movable blade 21 or 121 in accordance with a rotational direction of the driven gear 22*c*. Accordingly, an additional member for switching between the partial cutting and the full cutting is not required and it is possible to reduce cost, and it is also possible to reduce the risk of failure due to abrasion of a member.

In the printing apparatus 100 according to the embodiment, the movable blade 21 or 121 is a cutter blade of a V-shape that includes the cutting edge 21*a* and the cutting edge 21*b* as regions by which the thermal paper S is cut and the notch section 21*d* as a region which is provided between the cutting edges 21*a* and 21*b* and by which an uncut portion of the thermal paper S is formed.

Since the movable blade 21 or 121 has the V-shape, when the movable blade 21 or 121 moves in the cutting direction, the cutting edge 21*a* and the cutting edge 21*b* are able to cut the thermal paper S and the notch section 21*d* is able to form the uncut portion. Accordingly, it is possible to switch between the partial cutting and the full cutting of the movable blade 21 or 121 in accordance with a rotational direction of the driven gear 22*c*.

In the printing apparatus 100 according to the embodiment, when the driven gear 22*c* rotates in the first rotational direction, the movable blade 21 or 121 moves in the cutting direction in which the thermal paper S is cut and performs the partial cutting, and when the driven gear 22*c* rotates in the second rotational direction, the movable blade 21 or 121 moves in the direction inclined with respect to the cutting direction and performs the full cutting.

The movable blade 21 or 121 is able to move either in the cutting direction or in the direction inclined with respect to the cutting direction. Accordingly, it is possible to achieve the partial cutting and the full cutting of the movable blade 21 or 121 in accordance with a rotational direction of the driven gear 22*c*.

In the printing apparatus 100 according to the embodiment, when the driven gear 22*c* rotates in the second rotational direction, the guide shaft 21*f* or 121*f* changes the position with respect to the guide groove 21*i* or 121*i* along the certain portion of the second side 21*k* or 121*k* and the movable blade 21 or 121 moves in the direction inclined with respect to the cutting direction.

Since the second side 21*k* or 121*k* includes the certain portion extending in the direction away from the first side 21*j* or 121*j*, when the driven gear 22*c* rotates in the second rotational direction, the movable blade 21 or 121 is able to move in the direction inclined with respect to the cutting direction. Such a configuration enables the movable blade 21 or 121 to perform the full cutting.

In the printing apparatus 100 according to the embodiment, the movable blade 21 or 121 has the angled structure 21*m* including the cutting end 21*n*, and when the driven gear 22*c* rotates in the second rotational direction, the thermal paper S is cut by the cutting end 21*n* of the movable blade 21 or 121.

The uncut portion of the thermal paper S is able to be cut by hooking the uncut portion on the cutting end 21*n* of the movable blade 21 or 121. Accordingly, it is possible to more reliably achieve the full cutting of the movable blade 21 or 121.

In the printing apparatus 100 according to the embodiment, the cutting end 21*n*, which extends in the direction crossing the cutting direction, has a width larger than a width of an uncut portion of the thermal paper S.

Since the width of the cutting end 21*n* is larger than the width of the uncut portion of the thermal paper S, the uncut portion of the thermal paper S is easily hooked on the angled structure 21*m* and the uncut portion of the thermal paper S is able to be cut more reliably.

3. Other Embodiments

Note that the embodiments described above merely illustrate an aspect of the disclosure, and the specific aspects of the disclosure and the scope of application of the disclosure are not limited to the embodiments described above.

For example, the printing apparatus 100 illustrated in FIG. 1 has been described as a configuration in which the printing section 70 also functions as the transport section 70A that transports the thermal paper S. However, the disclosure is not limited to the configuration. For example, a configuration may be such that a transport roller or the like for transporting the thermal paper S is provided as the transport section 70A.

Further, for example, a medium cut by the cutter mechanism 20 or 120 to which the disclosure is applied is not limited to the thermal paper S having a roll shape, and may be plain paper wound into a roll or other kinds of sheets. Furthermore, the cutter mechanism 20 or 120 to which the disclosure is applied or the printing apparatus 100 including the cutter mechanism 20 or 120 may be configured to be incorporated into a device such as a multifunction peripheral or register.

What is claimed is:

1. A printing apparatus comprising:

a printer head configured to perform printing on recording paper; and a cutter arranged relative to the printer head, the cutter being configured to perform partial cutting in which a portion of the recording paper remains uncut and full cutting in which the recording paper is completely cut, the the cutter including:

a first blade configured to move in a cutting direction;

a plate configured to support the first blade; and a first rotating body that drives the first blade, wherein one of the first blade and the plate includes a guide groove, another of the first blade and the plate includes a guide shaft configured to be coupled to the guide groove, the guide groove has a first side and a second side, the second side includes a first portion that is opposite to the first side and extends along the first side, and a second portion that extends in a direction away from the first side such that a width of the guide groove in a direction crossing the cutting direction increases, when the first rotating body rotates in a first rotational direction to move the first blade toward the recording paper, the guide shaft changes a position with respect to the guide groove along the first side and the first blade performs the partial cutting, and when the first rotating body rotates in a second rotational direction different from the first rotational direction to move the first blade toward the recording paper, the guide shaft changes the position with respect to the guide groove along the second side and the first blade performs the full cutting.

2. The printing apparatus according to claim 1, wherein the first blade is a cutter blade of a V-shape that includes blade sections as regions by which the recording paper is cut and a notch section as a region which is provided between the blade sections and by which an uncut portion of the recording paper is formed.

3. A printing apparatus configured to perform printing on recording paper, the printing apparatus comprising:

a first blade including one of a guide shaft and a guide groove; and a first rotating body configured to drive the first blade, wherein the guide shaft is coupled to the guide groove, the guide groove has a first side and a second side, when the first rotating body rotates in a first rotational direction and the guide shaft changes a position with respect to the guide groove along the first side of the guide groove, the first blade moves in a cutting direction and performs partial cutting in which a portion of the recording paper remains uncut, and when the first rotating body rotates in a second rotational direction different from the first rotational direction and the guide shaft changes the position with respect to the guide groove along the second side of the guide groove, the first blade moves in a direction inclined with respect to the cutting direction and performs full cutting in which the recording paper is completely cut.

4. The printing apparatus according to claim 3, wherein the second side includes a certain portion that extends in a direction inclined with respect to a direction in which the first side extends, and when the first rotating body rotates in the second rotational direction, the guide shaft changes the position with respect to the guide groove along the certain portion of the second side and the first blade moves in the direction inclined with respect to the cutting direction.

5. The printing apparatus according to claim 3, wherein the first blade has an angled structure including a cutting end, and when the first rotating body rotates in the second rotational direction, the recording paper is cut by the cutting end of the first blade.

6. The printing apparatus according to claim 5, wherein the cutting end extends in a direction crossing the cutting direction and has a width larger than a width of a notch section of the first blade that is configured to form an uncut portion of the recording paper.

7. The printing apparatus according to claim 3, wherein the first blade is a cutter blade of a V-shape that includes blade sections as regions by which the recording paper is cut and a notch section as a region which is provided between the blade sections and by which an uncut portion of the recording paper is formed.

* * * * *